United States Patent [19]

Schultz et al.

[11] Patent Number: 4,840,820

[45] Date of Patent: Jun. 20, 1989

[54] ELECTROLESS NICKEL PLATING OF ALUMINUM

[75] Inventors: Paul B. Schultz, Farmington; Eugene F. Yarkosky, Milford, both of Conn.

[73] Assignee: Enthone, Incorporated, West Haven, Conn.

[21] Appl. No.: 786,988

[22] Filed: Oct. 15, 1985

Related U.S. Application Data

[63] Continuation of Ser. No. 663,826, Oct. 23, 1984, Pat. No. 4,567,066, which is a continuation of Ser. No. 525,358, Aug. 23, 1983, abandoned.

[51] Int. Cl.[4] ..... C23C 3/02

[52] U.S. Cl. ..... 427/305; 427/405; 427/406; 427/438

[58] Field of Search ..... 427/305, 405, 406, 438

[56] References Cited

U.S. PATENT DOCUMENTS

| | | | |
|---|---|---|---|
| 3,666,529 | 5/1972 | Wright | 427/305 |
| 4,169,171 | 9/1979 | Narcees | 427/305 |
| 4,346,128 | 8/1982 | Loch | 427/405 |

*Primary Examiner*—Sam Silverberg
*Attorney, Agent, or Firm*—John J. Tomaszewski; Kenneth A. Koch

[57] ABSTRACT

A process is provided for improving the electroless nickel plating of aluminum which has been pretreated with a barrier coating such as zinc by employing multiple plating baths under controlled operating conditions.

5 Claims, No Drawings

ELECTROLESS NICKEL PLATING OF ALUMINUM

This is a continuation of co-pending application Ser. No. 663,826 filed on Oct. 23, 1984, U.S. Pat. No: 4567066 which application is a continuation of Ser. No. 525,358, filed on Aug. 23, 1983, abandoned.

BACKGROUND OF THE INVENTION

The invention relates generally to a method for the electroless nickel plating of aluminum and its alloys.

Electroless nickel plating is a process which is very important in the metal finishing industry and which is widely employed for many metal substrates, including steel, copper, nickel, aluminum and alloys thereof. Plating metals such as aluminum, magnesium and their alloys present special problems to electroplaters, however, because, for one, they have surface oxide coatings which require special pre-plating operations to condition the surface for plating. While the present invention is applicable to the electroless plating of such metal substrates with metals such as nickel, cobalt and nickel-cobalt alloys, the description which follows will be primarily directed for convenience to the electroless nickel plating of aluminum and aluminum alloys which have been conditioned for plating by depositing a zinc coating on its surface.

In general, aluminum parts are first cleaned to remove organic surface contamination, followed by etching to eliminate solid impurities and alloying constituents from the surface, desmutting to remove the oxide film, and coating with a barrier layer such as zinc or tin to prevent re-oxidation of the cleaned surface. The parts are usually rinsed after each of the above steps and are now ready for electroless nickel plating.

Unfortunately, however, the electroless nickel plating bath used to plate zincated aluminum has a relatively short bath life when compared to baths to plate many other metal alloys such as plain steel. Thus, a bath which would normally be useful for, as an example, about ten turnovers for steel, may be useful on barrier coated aluminum for only about five turnovers. After this it must be discarded and replaced because the nickel deposits on the aluminum start to be blistered. A turnover may be defined as the period during which the quantity of nickel metal that has been plated out is equal to the quantity of nickel in the bath as made up. For example, for a bath initially containing about 6 g/l nickel, the bath would usually be replenished with nickel salts back to 6 g/l as the nickel is consumed during plating. The cumulative replenishment of 6 g/1 nickel represents one turnover.

Zincating is a commercially important process to pretreat aluminum surfaces because it is a relatively simple process requiring only immersion of the aluminum part in alkaline solution containing zincate ions. The amount of zinc deposited is actually very small and depends on the time and type of immersion bath used, the aluminum alloy, temperature of the solution and the pretreatment process; thicknesses up to about 0.1 microns are usually employed.

An alternative to the zincate process is shown in U.S. Pat. No. 3,666,529 to Wright et al. which discloses a method of conditioning aluminum surfaces bascially comprising etching the aluminum with an acidic nickel chloride solution to expose the aluminum crystals and deposit a nickel coating, removing the nickel coating with $HNO_3$, activating with an alkaline solution containing hypophosphite ions and then electrolessly plating an alkaline strike coat of nickel at 85° to 90° C., followed by electroless nickel deposition to the desired nickel thickness.

U.S. Pat. No. 3,672,964 to Bellis et al. discloses pretreating the aluminum surfaces with an aqueous solution of hydrofluoric acid and a material which is displaced by the aluminum and which is active to the electroless plating nickel, thereafter plating the treated aluminum surface with an electroless nickel bath which is at a pH of 6–7 and contains an amine borane and a monovalent or divalent sulfur compound. These patents however, do not address themselves to the problems encountered in the electroless nickel plating of zincated aluminum and only provide alternative processes which may be more costly and time consuming.

SUMMARY OF THE INVENTION

It has now been discovered that the electroless nickel plating of aluminum which has been pretreated with zinc or other barrier coating, may be improved by employing multiple plating baths under controlled operating conditions. Broadly stated, the process comprises applying a thin second barrier coating of nickel on the zincated surface from a nickel bath, e.g., electroless, followed by the use of another nickel bath to plate the surface to the desired thickness and physical characteristics. The process thus employs at least two nickel plating baths, the first of which is used to apply a thin second barrier coating of nickel on the zincated surface, with the second bath or baths, being used to plate the final nickel coating. The process has resulted in an almost doubled turnover life in the second bath as compared to the prior art process of using a single bath to plate the zincated aluminum to the desired thickness. Surprisingly, the first bath will last extensively before reaching its normal turnover limit even though it is being used to apply a second barrier coating directly onto a zinc surface, a process decidedly different from the prior art of plating to the desired thickness where the zincated surface is only in contact with the plating solution for a relatively short time. The result using the process of the invention is that the amount of work able to be processed through, e.g., two baths, in sequence, is substantially greater (approximately double) than if the two baths were used separately.

DESCRIPTION OF THE PREFERRED EMBODIMENTS

The aluminum part to be electrolessly nickel plated is, as discussed hereinabove, pretreated and provided with a barrier coating such as zinc, or other metals such as tin, using known techniques and procedures. Small amounts of metals, usually less than 10%, may be co-deposited with the barrier coating metal for purposes such as to modify the deposit properties of coatings thereon, among others. Many metals may be used such as cobalt, nickel, copper and iron.

Electroless nickel plating compositions for applying the nickel coatings and are well known in the art and plating processes and compositions are described in numerous publications. For example, compositions for depositing electroless nickel are described in U.S. Pat. Nos. 2,690,401; 2,690,402; 2,762,723; 2,935,425; 2,929,742; and 3,338,726. Other useful compositions for depositing nickel and its alloys are disclosed in the 35th Annual Edition of the Metal Finishing Guidebook for 1967, metal and plastics publications, Inc., Westwood, N.J., pages 483–486. Each of the foregoing publications are included herein by reference.

In general, electroless nickel deposition solutions comprise at least four ingredients dissolved in a solvent, typically water. They are (1) a source of the nickel ions, (2) a reducing agent such as a hypophosphite or an amine borane, (3) an acid or hydroxide pH adjustor to provide required pH and (4) a complexing agent for metal ions sufficient to prevent their precipitation in solution. A large number of suitable complexing agents for electroless nickel solutions are described in the above noted publications. In some formulations, the complexing agents are helpful but not a necessity. It will be appreciated by those skilled in the art that the nickel, or other metal being applied, is usually in the form of an alloy with the other materials present in the bath. Thus, if hypophosphite is used as the reducing agent, the deposit will contain nickel and phosphorous. Similarly, if an amine borane is employed, the deposit will contain nickel and boron. Thus, use of the term nickel includes the other elements normally deposited therewith.

The nickel ion may be provided by the use of any soluble salt such as nickel sulfate, nickel chloride, nickel acetate and mixtures thereof. The concentration of the nickel in solution may vary widely and is about 0.1 to 100 g/l, preferably about 2 to 50 g/l, e.g., 2 to 10 g/l.

The reducing agent is usually the hypophosphite ion supplied to the bath by any suitable source such as sodium, potassium, ammonium and nickel hypophosphite. Other reducing agents such as amine boranes, borohydrides and hydrazine may also suitably be employed. The concentration of the reducing agent is generally in excess of the amount sufficient to reduce the nickel in the bath.

The baths may be acid, neutral or alkaline and the acid or alkaline pH adjustor may be selected from a wide range of materials such as ammonium hydroxide, sodium hydroxide, hydrochloric acid and the like. The pH of the bath may range from about 2 to 11.5, with a range of 7 to 12, e.g., 9 to 11, being preferred for the bath used to deposit the second barrier coating and a range of 2 to 7, e.g., 4 to 6, being preferred for the bath used to deposit the final layer of nickel.

The complexing agent may be selected from a wide variety of materials containing anions such as acetate, citrate, glycollate, pyrophosphate and the like, with mixtures thereof being suitable. Ranges from the complexing agent, based on the anion, may vary widely, for example, about 0 to 300 g/l, preferably about 5 to 50 g/l.

The electroless nickel plating baths may also contain other ingredients known in the art such as buffering agents, bath stabilizers, rate promoters, brighteners, etc.

A suitable bath may be formed by dissolving the ingredients in water and adjusting the pH to the desired range.

The zinc barrier coated aluminum part may be plated with the second barrier coating by electroless nickel plating, by immersing the part in an electroless nickel bath to a thickness adequate to provide a suitable barrier coating for blister-free deposits on the final nickel plate, e.g., up to about 0.1 mil, or higher, with 0.005 to 0.08 mils, e.g., 0.01 to 0.05, being preferred. An immersion time of 15 seconds to 15 minutes usually provides the desired coating, depending on bath parameters. A temperature range of about 25° C. to boiling, e.g., 100° .C, may be employed, with a range of about 30° to 95° C. being preferred.

The next step in the procedure is to complete the nickel plating to the desired thickness and physical characteristics by immersing the nickel part in another electroless nickel plating bath which is maintained over a temperature range of about 30° C. to 100° C., e.g., boiling, preferably 80° C. to 95° C. A thickness up to 5 mils, or higher may be employed, with a range of about 0.1 to 2 mils used for most applications.

It will be appreciated by those skilled in the art that the rate of plating may be influenced by many factors including (1) pH of the plating solution, (2) concentration of reductant, (3) temperature of plating bath, (4) concentration of soluble nickel, (5) ratio of volume of bath $cm.^3$/area plated $cm.^2$, (6) presence of soluble fluoride salts (rate promoter) and (7) presence of wetting agent and/or agitation, and that the above parameters are only provided to give general guidance for practising the invention; the invention residing in the use of multiple baths as hereinbefore described to provide an enhanced plating process.

Examples illustrating various plating baths and conditions under which the process may be carried out follows.

EXAMPLE I

Aluminum Association Number 3003 aluminum panels $2\frac{1}{2} \times 4$ inch were alkaline cleaned, water rinsed, acid etched, water rinsed, desmutted and water rinsed. The panels were then zincated at room temperature for 30 seconds using an aqueous solution containing 100 g/l ZnO, 500 g/l NaOH, 1 g/l $FeCl_3$ and 10 g/l Rochelle salt. The panels were water rinsed and a number of the panels plated in an electroless nickel plating bath sold by Enthone, Incorporated under the name ENPLATE NI-431 by immersion in the bath, which was maintained at about 90° C., for about 30 minutes. A coating of about 0.4 mils was obtained on each panel. The nickel and hypophosphite concentration were replenished when the concentration fell to about 4 g/l nickel. A total of about 5 turnovers were obtained before the nickel plating started to blister. It is at this point that the bath normally cannot be further used to plate zincated aluminum and must be discarded.

A zincated aluminum panel prepared as above was plated with a thin second barrier coating of nickel (about 0.02 mil) in the following electroless nickel plating bath for 3 minutes at 40° C.:

Nickel Sulfamate: 24 g/l

Tetra Potassium Pyrophosphate: 60 g/l

Sodium Hypophosphite $NH_4OH$ to a pH of 10: 27 g/l

It was then immersed in the plating bath having 5 turnovers and received a blister-free nickel deposit. An immersion time of about 30 minutes produced a nickel thickness of about 0.4 mils. Upon removing the plated panel, a zincated panel (with no nickel second barrier coating) was immersed in the same bath, and the coating was blistered. The above sequence was repeated a number of times, with the second barrier nickel coated zincated aluminum panel obtaining blister-free deposits as compared with the blistered deposits obtained on the zincated aluminum (without the thin second barrier nickel coating). Another 4 turnovers were obtained resulting in a total of about 9 turnovers for the bath. The bath was still useful at this point to plate on the second barrier coated panels but the plating rate was very slow, as is usual when a bath has reached about 9–10 turnovers.

The example demonstrates that the life of an electroless nickel plating bath used to plate zincated aluminum may be increased if the zincated aluminum has a thin second barrier nickel coating before immersion in the bath.

EXAMPLE II

A zincated aluminum panel as described above was plated with a thin second barrier coating of nickel (about 0.02 mil) for 5 minutes at 65° C. in an electroless plating bath containing the following ingredients and adjusted to pH 7.5 with $NH_4OH$:

$NiSO_4 \times 6\ H_2O$: 4 g/l
$CoSO_4 \times 7\ H_2O$: 28 g/l
Na Citrate$\times 2\ H_2O$: 75 g/l
Ammonium Hydroxide: 9.4 g/l
Na Hypophosphite: 28 g/l
$NH_4Cl$: 42 g/l When the panel was immersed in the plating bath of Example I (having 5 turnovers), it received a blister-free nickel deposit. A zincated panel with no thin nickel coating was immersed in the same bath, and the deposit was blistered.

EXAMPLE III

Example II was repeated using ENPLATE NI-431 sold by Enthone, Incorporated to electrolessly plate the thin nickel second barrier coating with the same results being obtained, to wit, the second barrier coated panels receiving blister-free deposits and the zinc coated panels receiving blistered deposits.

While there has been described what is at present considered to be the preferred embodiment of the invention, it will be understood that various modifications may be made therein, and it is intended to cover in the appended claims all such modifications as fall within the true spirit and scope of the invention.

We claim:

1. In a process for plating zinc or tin coated aluminum substrates with an adherent, non-blistered electroless metal coating by metal plating from a first electroless plating bath to the desired thickness, the bath being replenished as needed to maintain the desired metal concentration, and with the bath being used until the electroless metal coatings produced on the substrates are non-adherent and blistered after which the bath is discarded, the improvement whereby the lift of the bath is increased comprising:

plating a thin coating of the metal on the substrates from a second electroless metal plating bath prior to plating to the desired thickness with the first bath, both electroless metal plating baths containing a source of metal ions and a reducing agent to reduce the metal ions.

2. The process of claim 1 wherein the thin metal coating on the zinc coating is up to about 0.1 mil.

3. The process of claim 2 wherein the thin metal coating on the zinc coating is about 0.005 to 0.08 mils.

4. The process of claim 1 wherein the metal baths are cobalt, copper, nickel or alloys thereof.

5. The process of claim 4 wherein the metal is nickel.

* * * * *